US011498109B2

(12) United States Patent
Viale et al.

(10) Patent No.: US 11,498,109 B2
(45) Date of Patent: Nov. 15, 2022

(54) METHODS OF FORMING CLOSURE MEMBERS

(71) Applicant: Guala Closures S.p.A., Alessandria (IT)

(72) Inventors: Luca Viale, Alessandria (IT); Marco Giovannini, Luxembourg (LU); Andrea Pozzi, Pavia (IT)

(73) Assignee: Guala Closures S.p.A., Alessandria (IT)

( * ) Notice: Subject to any disclaimer, the term of this patent is extended or adjusted under 35 U.S.C. 154(b) by 603 days.

(21) Appl. No.: 16/062,825

(22) PCT Filed: Dec. 16, 2016

(86) PCT No.: PCT/EP2016/081426
§ 371 (c)(1),
(2) Date: Jun. 15, 2018

(87) PCT Pub. No.: WO2017/108611
PCT Pub. Date: Jun. 29, 2017

(65) Prior Publication Data

US 2019/0001391 A1 Jan. 3, 2019

(30) Foreign Application Priority Data

Dec. 23, 2015 (EP) ..... 15202580

(51) Int. Cl.
*B21D 26/14* (2006.01)
*B21D 51/44* (2006.01)

(52) U.S. Cl.
CPC ..... *B21D 26/14* (2013.01); *B21D 51/44* (2013.01)

(58) Field of Classification Search
CPC ..... B21D 51/44; B21D 26/14; B21D 51/50
See application file for complete search history.

(56) References Cited

U.S. PATENT DOCUMENTS 3,217,397 A * 11/1965 Voss ..... B21D 51/50 29/430
3,581,456 A * 6/1971 Gere ..... B21D 26/14 53/488

(Continued)

FOREIGN PATENT DOCUMENTS

DE 10 2005 046428 A1 3/2007
WO 2014/090902 A1 6/2014

OTHER PUBLICATIONS

Andrew Boyd, "No. 2576 Screw Caps for Wine", https://www.uh.edu/engines/epi2576.htm (Year: 2015).*

(Continued)

*Primary Examiner* — Adam J Eiseman
*Assistant Examiner* — Bobby Yeonjin Kim
(74) *Attorney, Agent, or Firm* — MH2 Technology Law Group LLP

(57) ABSTRACT

A method of forming a closure member may include: providing a support member with an outer support surface; providing a member including a first member made of electrically conductive material, wherein the first member includes a first tubular sleeve extending along a longitudinal direction between a first top end and a first bottom end; positioning the member on the support member; applying a magnetic field on the member to deform at least a portion of the first tubular sleeve around the support member to form the closure member; and/or removing the formed closure member from the support member for subsequently fitting the formed closure member on a neck of a container or a closure body.

20 Claims, 7 Drawing Sheets

(56) References Cited

U.S. PATENT DOCUMENTS

| | | | | |
|---|---|---|---|---|
| 3,746,202 | A * | 7/1973 | Moller | B65D 41/32 215/253 |
| 5,246,124 | A * | 9/1993 | Battegazzore | B65D 49/06 215/251 |
| 5,444,963 | A * | 8/1995 | Steingroever | B67B 3/10 29/419.2 |
| 2005/0138984 | A1* | 6/2005 | Cook | B21D 43/18 72/361 |
| 2007/0062952 | A1* | 3/2007 | Kobayashi | B21D 51/50 220/288 |
| 2010/0275439 | A1* | 11/2010 | Pasquale | B67B 3/10 29/795 |
| 2019/0001390 | A1* | 1/2019 | Dick | B21D 51/40 |

OTHER PUBLICATIONS

International Search Report and Written Opinion dated Mar. 14, 2017, in PCT Application No. PCT/EP2016/081426, 11 pages.

* cited by examiner

METHODS OF FORMING CLOSURE MEMBERS

CROSS-REFERENCE TO RELATED APPLICATION(S)

This application is a national stage entry from International Application No. PCT/EP2016/081426, filed on Dec. 16, 2016, in the Receiving Office ("RO/EP") of the European Patent Office ("EPO"), and published as International Publication No. WO 2017/108611 A1 on Jun. 29, 2017; International Application No. PCT/EP2016/081426 claims priority from European Patent Application No. 15202580.5, filed on Dec. 23, 2015, in the EPO, the entire contents of all of which are incorporated herein by reference.

TECHNICAL FIELD

The present invention relates to a method of forming a closure member.

In particular, the present invention relates to a method of forming a closure member by magnetic forming.

BACKGROUND OF THE INVENTION

Magnetic forming process is known in the state of art and has been employed in various applications.

In a magnetic forming process, a coil surrounds the workpiece, made of electrically conductive material, which is to be deformed, at a small distance. When an electric current flows through this coil, a magnetic field forms, which encloses the element to be deformed, and therein induces eddy currents in its surface, which in turn generate a second magnetic field with a direction opposite to the first, for which reason the two fields repel one another. Thereby, on the circumference of the workpiece, in the plane of the electric coil, a force develops which is oriented radially to the center point of the workpiece.

U.S. Pat. No. 5,246,124 discloses a method of forming a closure by magnetic forming. This document discloses a closure for bottles comprising a pouring body and a cap releasably engaged with the pouring body. The cap is attached to a tubular outer skirt abutting an annular outer portion of a collar attached with the pouring body. The skirt and the annular outer portion are interconnected by a frangible outer ring binding the skirt and the annular outer portion of the collar together. An outer metallic band is fitted around the outer ring in close contact therewith. The outer metallic band is set tightly around the outer ring by magnetic forming process.

The magnetic forming process is carried out by generating a quickly varying, high-energy magnetic field, e.g. by the supply of a high-current pulse through suitable leads arranged to induce a current through the band.

The energy transferred to the band by interaction between the induced current and the magnetic field is of such a level as to create a force which causes the band to shrink radially and set tightly around the outer surface of the outer ring.

The closure is assembled by mounting all the components together and finally setting the band around the ring by magnetic forming. The closure so assembled is ready to be mounted on a neck of a bottle.

U.S. Pat. No. 5,246,124 therefore discloses the use of magnetic forming process to form a metallic band on a plastic ring of a closure.

Different applications of the magnetic forming are disclosed in US 2010/275439 and WO 2014/090902.

US 2010/275439 discloses a method for sealing containers with a metal cap by magnetic forming by a multiple tube processing coil.

WO 2014/090902 discloses a method of assembling a cover with a container.

The magnetic forming methods disclosed by the above cited prior art references are not suitable to form a closure member to be subsequently applied on a container neck or a closure body.

SUMMARY OF THE INVENTION

The object of the present invention is to provide a method of forming a closure member with any shape for subsequently applying the formed closures member on a container neck or a closure body.

The present invention relates to a method of forming a closure member, the method comprising the steps of:

providing a support member with an outer support surface, providing a member comprising a first member made of electrically conductive material, the first member comprising a first tubular sleeve extending along a longitudinal direction between a first top end and a first bottom end, positioning the member on the support member, applying a magnetic field on the member to deform at least a portion of the first tubular sleeve around the support member to form a closure member, removing the formed closure member from the support member for subsequently fitting the formed closure member on a neck of a container or a closure body.

BRIEF DESCRIPTION OF THE DRAWINGS

The characteristics and advantages of the present invention will appear from the following detailed description, which is given as a non-limiting example with reference to the annexed drawings, in which.

DETAILED DESCRIPTION

Figure 1:
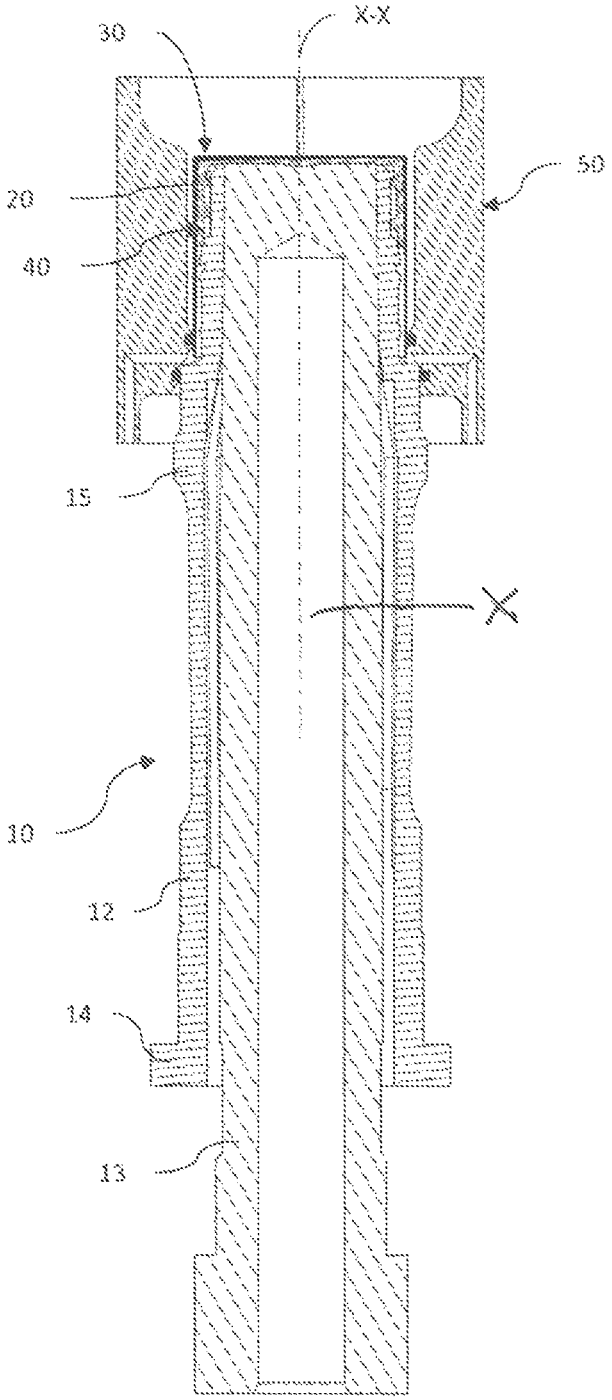
FIG. 1 shows a first embodiment of an apparatus for carrying out the method of the present invention with a member to be formed.
Figure 2:
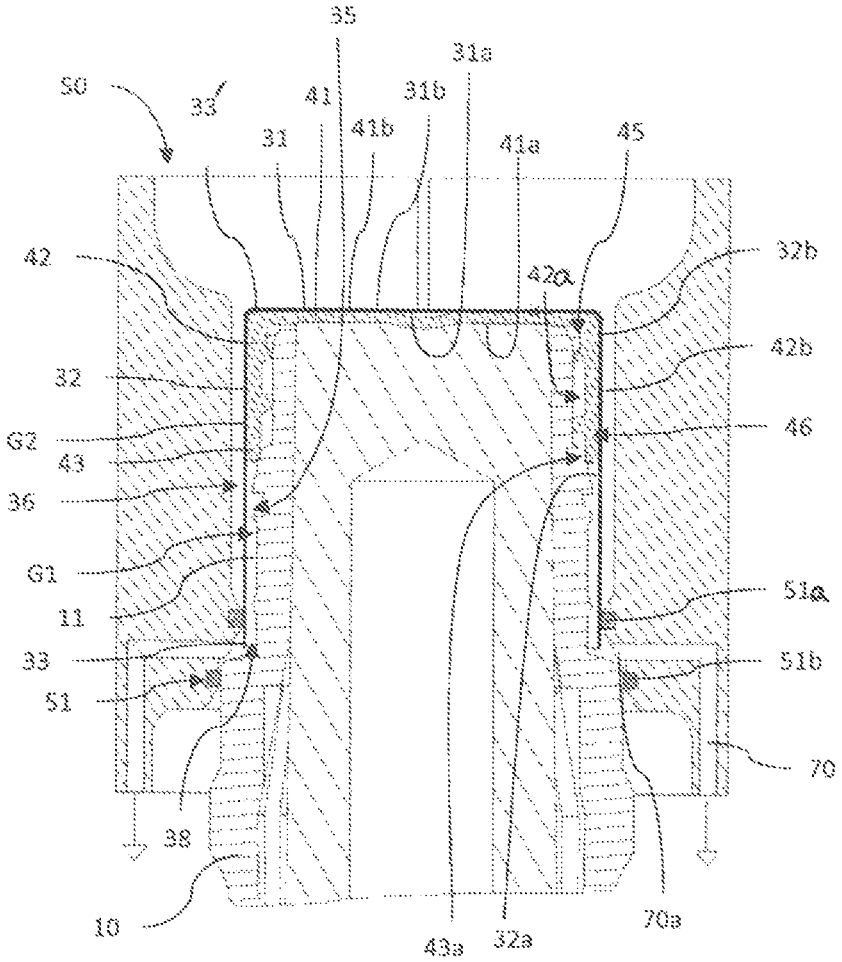
FIG. 2 shows an enlarged view of a detail of FIG. 1.
Figure 3:
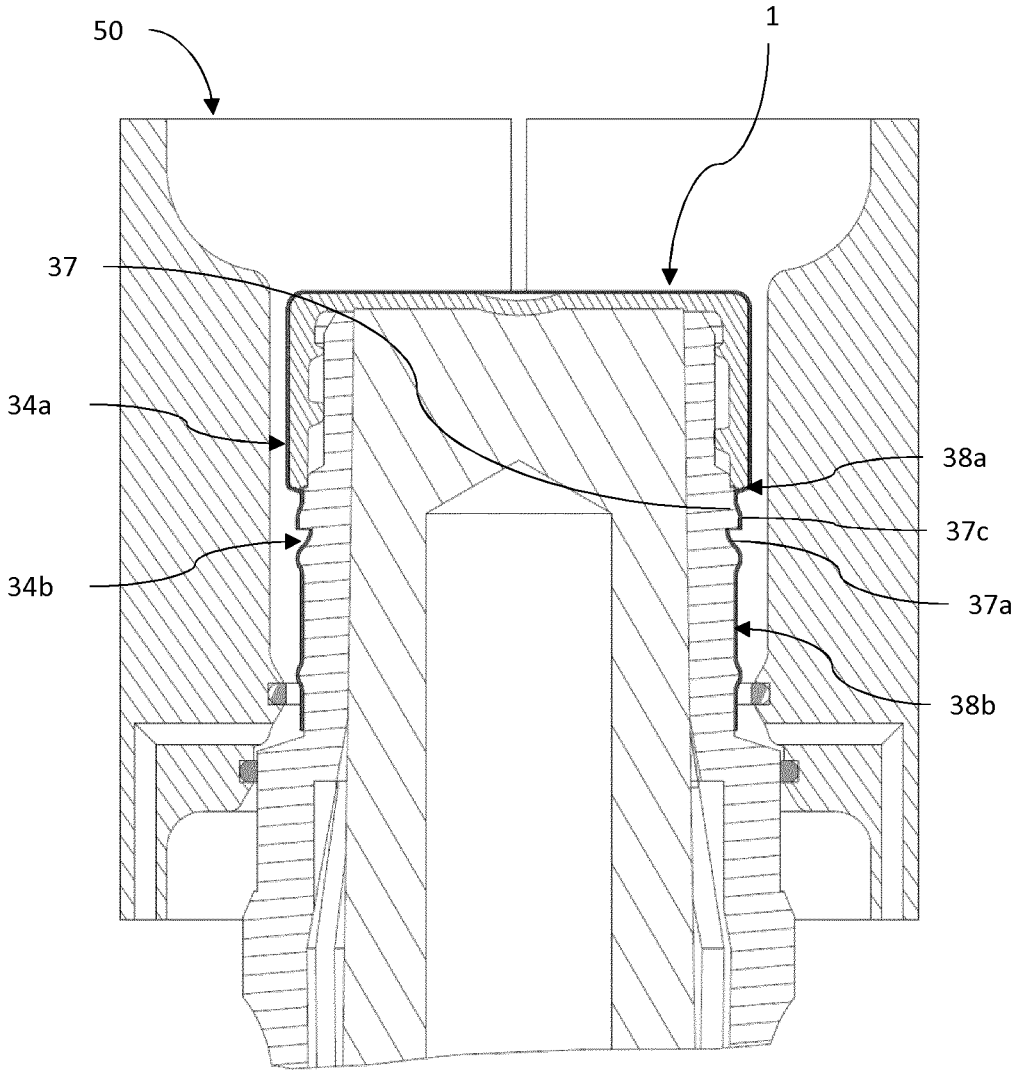
FIG. 3 shows the arrangement of FIG. 2 with the formed closure.
Figure 4:
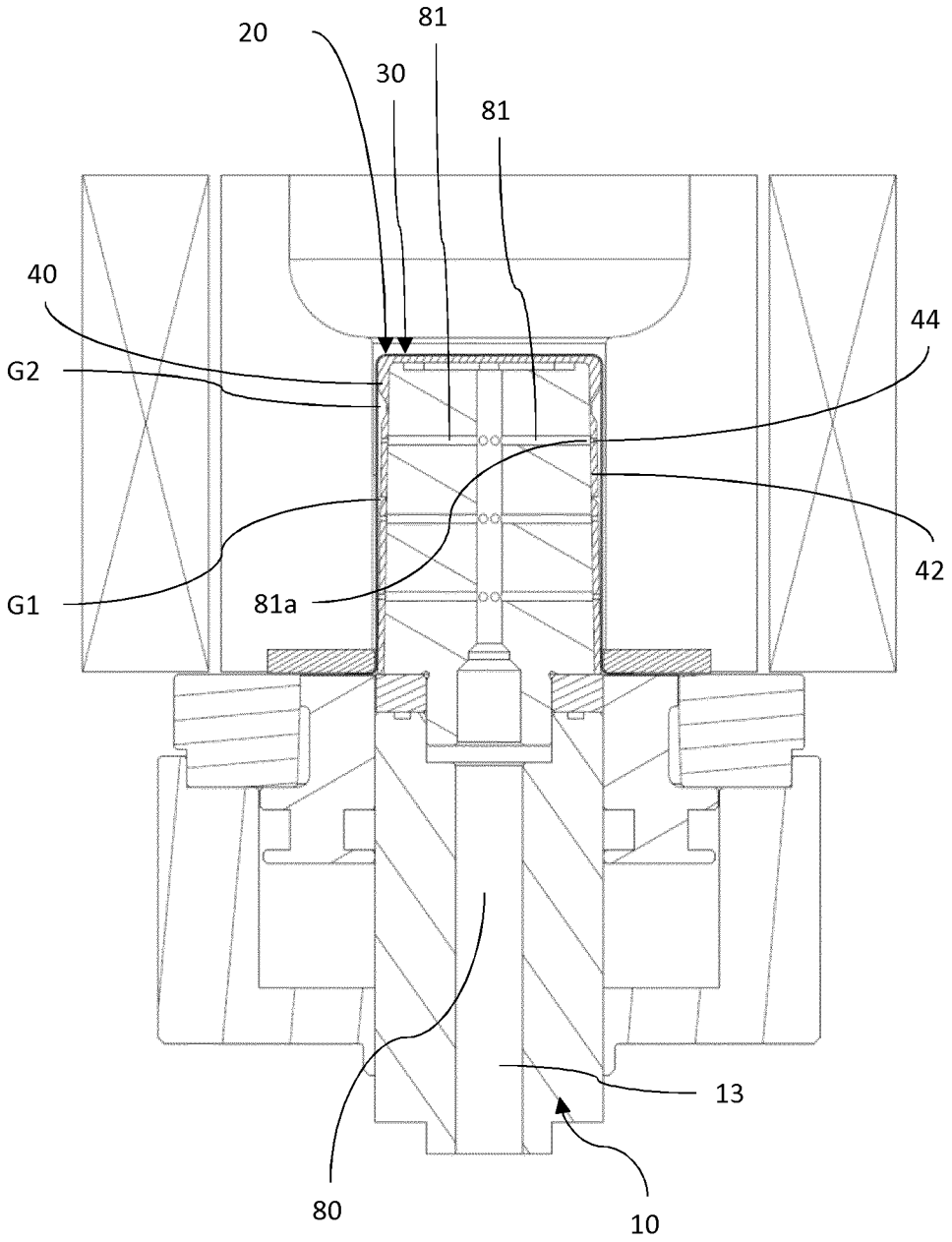
FIG. 4 shows a second embodiment of an apparatus for carrying out the method of the present invention with a member to be formed.
Figure 5:
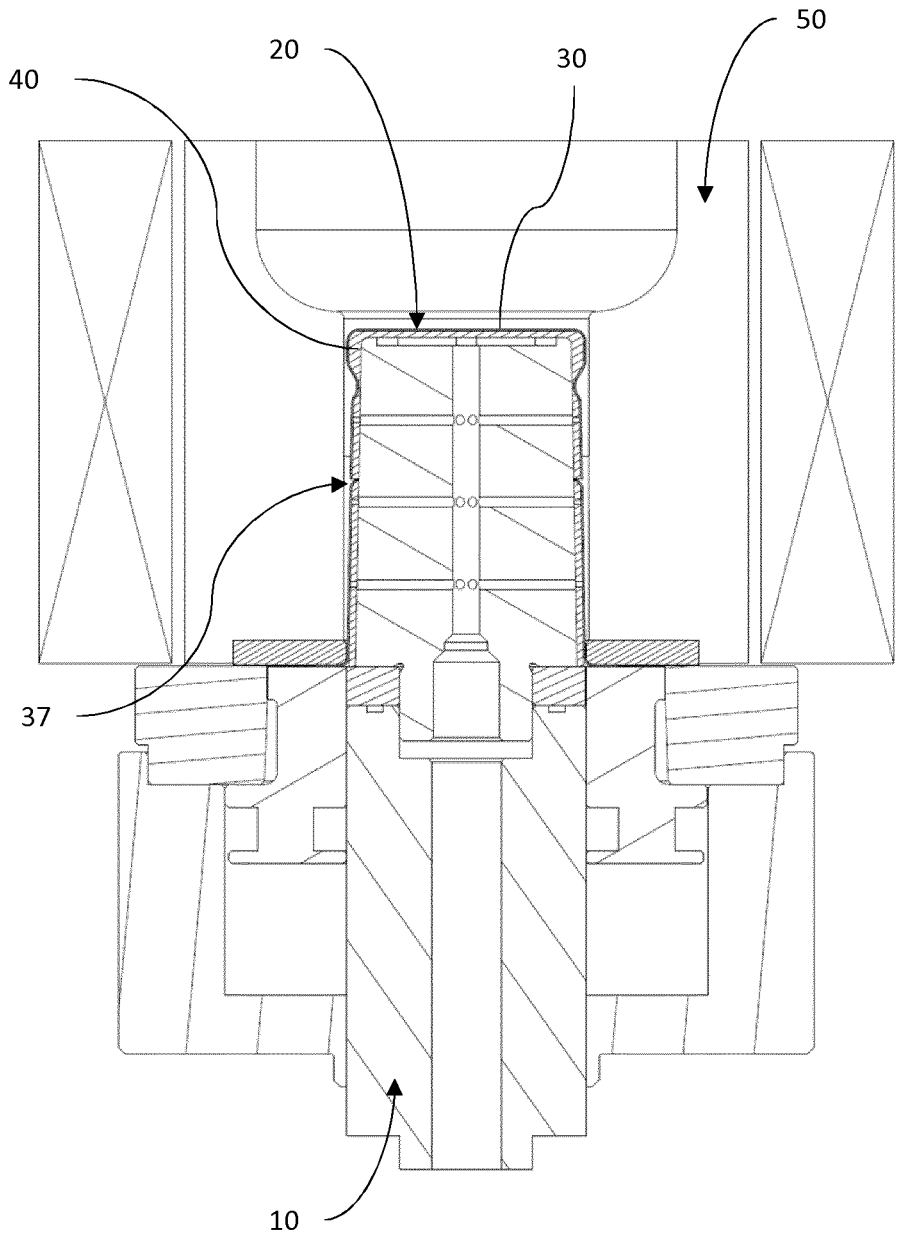
FIG. 5 shows the arrangement of FIG. 4 with the formed closure.
Figure 6:
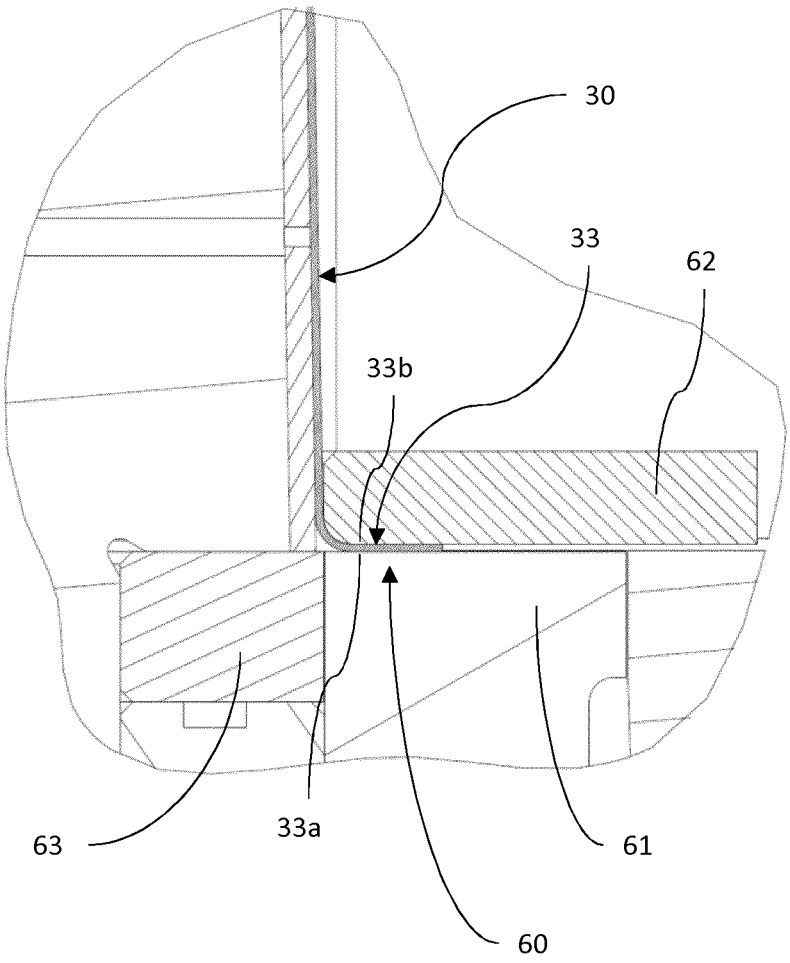
FIG. 6 show a detail of the apparatus of FIG. 5.
Figure 7:
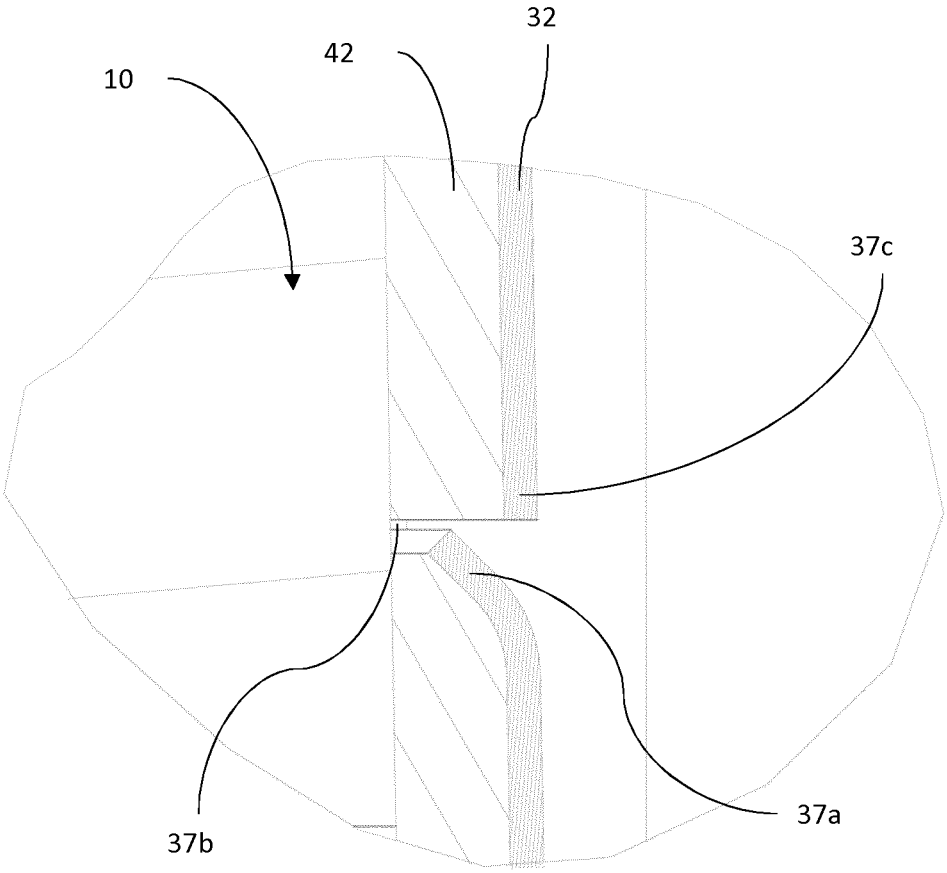
FIG. 7 shows a detail of the formed closure shown in FIG. 5.

Referring to the figures, there is shown a closure member 1 formed according to the method of the present invention.

The closure member 1 is configured to be fitted directly on a neck of a container or a closure body.

The term "neck" in connection with a container having a container body may refer to a neck made as one piece element with the container body or to a pouring body firmly attached to the neck made as one piece with the container body.

The term "closure body" refers to any part of a closure such a threaded cap, a hinged lid cap or flip top cap, a push-on cap, a pourer and the like.

If the closure member 1 is configured to be fitted directly on a neck of a container, the closure member 1 may be provided with attachment members configured to engage with attachment members formed on the neck to attach the closure member 1 to the neck. Alternatively, the closure member 1 may be attached to the neck by deforming a part of the closure member 1, mechanically or magnetically, for example as disclosed in US 2010/275439 or WO 2014/090902.

A support member 10 is provided. The support member 10 extends along a longitudinal direction X-X, has a support axis X extending along the longitudinal direction X-X and has an outer support surface 11.

According to one embodiment, the support member 10 comprises a male element 12 and a stem 13 positioned inside the male element 12. Preferably, the male element 12 comprises a base 14 and a plurality of legs 15 arranged spaced circumferentially and projecting longitudinally from the base 14. The legs 15 are connected elastically to the base 14 so as to be radially movable with respect to the base 14 and consequently with respect to the stem 13 arranged therein.

The stem 13 is movable longitudinally to act on the legs 15 of the male element 12 to increase and decrease the radial position of the legs 15 with respect to the stem 13 and the support axis X.

A member 20 is also provided.

According to a first embodiment, the member 20 comprises a first member 30 made of electrically conductive material, preferably aluminum.

Preferably the first member 30 is made of sheet material, more preferably with thickness between 0.2 millimeters (mm) and 0.3 mm, still more preferably with thickness between 0.21 mm and 0.25 mm, still more preferably with a thickness of 0.23 mm.

According to the embodiment shown in the figures, the first member 30 is shaped as a capsule closed on top and open on the bottom. The first member 30 has therefore a first top wall 31 and a first tubular sleeve 32 extending along the longitudinal direction X-X between the first top wall 31 and a first bottom end 33.

The first bottom end 33 defines a bottom opening 38 of the first member 30. Therefore, the first tubular sleeve 32 is closed on top by the first top wall 31 and has the bottom opening 38 on the bottom.

The first member 30 has a first inner surface 35 and a first outer surface 36.

The first top wall 31 has a first inner top surface 31*a* and a first outer top surface 31*b*.

The first tubular sleeve 32 has a first inner tubular surface 32*a* and a first outer tubular surface 32*b*.

The first inner surface 35 comprises the first inner top surface 31*a* and the first inner tubular surface 32*a*.

The first outer surface 36 comprises the first outer top surface 31*b* and the first outer tubular surface 32*b*.

Alternatively, the first member 30 may be a tubular sleeve open on top and bottom and, for example, defined only by the first tubular sleeve 32 extending longitudinally between a first top end 33', where the first top wall 31 is provided, and the first bottom end 33.

According to a second embodiment, the member 20 further comprises a second member 40 made of electrically insulating material, preferably plastic material.

The second member 40 is arranged inside the first member 30 and comprises a second top wall 41 and a second tubular sleeve 42 extending along the longitudinal direction X-X from the second top wall 41 to a second bottom end 43.

In the example shown in the attached figures, the second member 40 is a threaded cap. However, the second member 40 may be a hinged lid cap or flip top cap, a push-on cap, a pourer and the like. When the second member 40 is a hinged lid cap or a pourer, the first member 30 may not be closed on top and may be a tubular sleeve open on top and bottom.

The second bottom end 43 defines a bottom opening 43*a* of the second member 40. Therefore, the second tubular sleeve 42 is closed on top by the second top wall 41 and has the bottom opening 43*a* on the bottom.

The second member 40 has a second inner surface 45 and a second outer surface 46.

The second top wall 41 has a second inner top surface 41*a* and a second outer top surface 41*b*.

The second tubular sleeve 42 has a second inner tubular surface 42*a* and a second outer tubular surface 42*b*.

The second inner surface 45 comprises the second inner top surface 41*a* and the second inner tubular surface 42*a*.

The second outer surface 46 comprises the second outer top surface 41*b* and the second outer tubular surface 42*b*.

The member 20 is positioned on the support member 10 so that the first inner surface 35 of the first member 30 faces the outer support surface 11 of the support member 10.

According to the embodiment with the member 20 comprising only with first member 30, a first annular gap G1 is defined between the first inner surface 35 of the first tubular sleeve 32 and the outer support surface 11 of the support member 10. The first annular gap G1 extends radially between the first tubular sleeve 32 and the outer support surface 11 and longitudinally along the longitudinal extension of the first tubular sleeve 32.

According to the embodiment with the member 20 comprising the first member 30 and the second member 40, a second annular gap G2 is defined between the first tubular sleeve 32 and the second tubular sleeve 42. The second annular gap G2 extends radially between the first tubular sleeve 32 and the second tubular sleeve 42 and longitudinally along a mutually overlapping portion of the first tubular sleeve 32 and the second tubular sleeve 42. Depending on the relative longitudinal extension of the first member 30 and the second member 40, the first annular gap G1 may be between the portion of the first member 30 advancing longitudinally the second member 40 and the outer support surface 11 of the support member 10.

An induction coil 50 is arranged closely around the member 20 to entirely surround the member 20. The induction coil 50 is powered and controlled by an electric power generation and control unit (not shown in the figures) to generate a magnetic field, in particular a pulsed magnetic field that generates a pulsed magnetic force on the first member 30.

Preferably the pulsed magnetic field has a width of 10 μs and a cycle of 1 pulse per 5 seconds.

This magnetic field generated by the induction coil 50 is applied to the first member 30 to deform the first tubular sleeve 32 of the first member 30 around the support member 10 to form the closure member 1. In particular, the magnetic field bends the first member 30 in a radially inward direction around the support member 10, more particularly around the outer support surface 11.

The formed closure member 1 is then removed from the support member 10 for subsequently fitting it on a neck of a container or a closure body.

At least a portion of the first tubular sleeve 32 is deformed directly against the support member 10 so that the deformed portion of the first tubular sleeve 32 is shaped as the outer support surface 11 of the support member 10. This means that the deformed portion of the first tubular sleeve 32 follows the shape of the outer support surface 11 of the support member 10.

According to the embodiment with only the first member 30, the first tubular sleeve 32 deforms directly against the outer support surface 11 of the support member along the entire longitudinal extension of the first tubular sleeve 32.

According to the embodiment with the first member 30 and the second member, an upper portion 34*a* of the first tubular sleeve 32 deforms directly against the second tubular sleeve 42 of second member 40 along the mutually overlapping portion of the first tubular sleeve 32 on the second tubular sleeve 42.

A lower portion 34*b* of the first tubular sleeve 32 deforms directly against the outer support surface 11 of the support member 10.

According to one embodiment, the first tubular sleeve 32 has a circumferential portion 37. In this circumferential portion 37, circumferentially spaced first portions 37*a* and circumferentially spaced second portions 37*b* adjacent to the first portions 37*a* are defined such that the first portions 37*a* and the second portions 37*b* are arranged circumferentially in alternate arrangement.

Third portions 37*c* are defined as portions longitudinally adjacent to the first portions 37*a*.

The first portions 37*a* are deformed such that these first portions 37*a* separate from the third portions 37*c* while the second portions 37*b* are underformed. To this purpose, the outer support surface 11 of the support member 10 or the second tubular sleeve 42 are so shaped that the inwardly radial deformation of first portions 37*a* stretches the material between the first portions 37*a* and the third portions 37*c* until a break occurs, thereby separating the first portions 37*a* from the third portions 37*c*.

The second portions 37*b* form frangible portions connecting an upper part 38*a* of the first tubular sleeve 32 with a lower part 38*b* of the first tubular sleeve 32.

The frangible second portions 37*b* are configured to break upon moving the upper part 38*a* away from the lower part 38*b* along the longitudinal direction X-X, for example, upon first opening of a closure comprising the closure member 1.

According to one embodiment, a vacuum is generated between the member 20 and the support member 10 before applying the magnetic field. This prevents or at least mitigates generation of air bubbles during the deformation of the first tubular sleeve 32.

Preferably, the vacuum is a low vacuum between 0.1 bar and 0.8 bar, preferably 0.2 bar.

According to a first embodiment, the induction coil 50 comprises sealing members 51 configured to cooperate with the first member 30 and with the support member 10 to seal, from outside environment, the first annular gap G1 between the first member 30 and the support member 10.

In particular, the sealing members 51 comprise a first sealing member 51*a* cooperating with the first outer surface 36 of the first tubular sleeve 32, more particularly with the first outer tubular surface 32*b* of the first tubular sleeve 32, and a second sealing member 51*b* cooperating with the outer support surface 11 of the support member 10.

In order to generate the vacuum, a vacuum channel 70 is provided in the induction coil 50. The vacuum channel 70 is connected to a vacuum pump (not shown in the figures) and has a vacuum port 70*a* positioned such that, in use, it is arranged longitudinally between the first sealing member 51*a* and the second sealing member 51*b*. In this position the vacuum port 70*a* allows to suck air from the first annular gap G1.

According to a second embodiment, sealing members 60 are provided and configured to cooperate with the first member 30 to seal, from outside environment, the first annular gap G1 between the first member 30 and the support member 10.

In this second embodiment, the sealing members 60 comprise a first plate 61 and an opposite second plate 62 configured to receive and hold the first bottom end 33 of the first member 30 therebetween. In particular, the first plate 61 is configured to act on an inner surface 33*a* of the first bottom end 33 and the second plate 62 is configured to act on an outer surface 33*b* of the first bottom end 33 to hold the first bottom end 33.

A cutting blade 63 is provided to cooperate with the first plate 61 to cut the portion of the first tubular sleeve 32 held between the first and second plates 61, 62.

In order to generate the vacuum, a plurality of radial vacuum channels 81 are formed in the support member 10. The radial vacuum channels 81 radially extend from a central vacuum channel 80 connected to a vacuum pump (not shown in the figures).

Each radial vacuum channel 81 has a vacuum port 81*a* facing the member 20. With the embodiment with only the first member 30, each vacuum port 81*a* directly communicates with the first annular gap G1 between the support member 10 and the first member 30.

Preferably, the central vacuum channel 80 and the radial vacuum channels 81 are formed in the stem 13 of the support member 10.

When the member 20 is provided also with the second member 40 inside the first member 30, the second member 40 preferably comprises a plurality of through holes 44 allowing to suck air from the second annular gap G2. Preferably, the through holes 44 are formed in the second tubular sleeve 42 and are arranged spaced circumferentially and define longitudinally spaced groups of circumferentially spaced through holes.

The invention claimed is:

1. A method of forming a closure member, the method comprising:

providing a support member comprising an outer support surface, a male element, and a stem inside the male element;

providing a member comprising a first member made of electrically conductive material, wherein the first member comprises a first tubular sleeve extending along a longitudinal direction between a first top end and a first bottom end;

positioning the member on the support member;

applying a magnetic field on the member to deform at least a portion of the first tubular sleeve around the support member to form the closure member;

removing the stem from the male element; and after the stem has been removed from the male element, extracting the male element from the formed closure member;

wherein positioning the member on the support member comprises moving the support member relative to the member along the longitudinal direction until the male element of the support member contacts a first inner top surface of the first member, and wherein the formed closure member is configured to be applied on a neck of a container to be closed or on a closure body.

2. The method of claim 1, wherein a first annular gap is defined between the first tubular sleeve and the outer support surface, and wherein the at least the portion of the first tubular sleeve is deformed directly against the support member so that the deformed portion of the first tubular sleeve is shaped as the outer support surface of the support member.

3. The method of claim 1, wherein in a circumferential portion of the first tubular sleeve, circumferentially spaced first portions and circumferentially spaced second portions adjacent to the first portions are defined such that the first portions and the second portions are arranged circumferentially in alternate arrangement, wherein third portions are defined as portions longitudinally adjacent to the first portions, wherein when the magnetic field is applied, the first portions are deformed such that the first portions separate from the third portions and the second portions are underformed, wherein the second portions form frangible portions connecting an upper part of the first tubular sleeve with a lower part of the first tubular sleeve, and wherein the frangible portions are configured to break upon moving the upper part away from the lower part along the longitudinal direction.

4. The method of claim 1, wherein the first member is made of sheet material with thickness greater than or equal to 0.2 millimeters (mm) and less than or equal to 0.3 mm.

5. The method of claim 1, wherein the first member is made of aluminum.

6. The method of claim 1, wherein the first member is made of sheet material with thickness greater than or equal to 0.21 millimeters (mm) and less than or equal to 0.25 mm.

7. The method of claim 1, wherein the first member is made of sheet material with thickness of 0.23 millimeters (mm).

8. The method of claim 1, wherein the applying of the magnetic field on the member comprises applying a pulsed magnetic field on the member.

9. The method of claim 8, wherein the pulsed magnetic field has a pulse width of 10 microseconds ("μs").

10. The method of claim 8, wherein the pulsed magnetic field has a cycle of 1 pulse per 5 seconds.

11. A method of forming a closure member, the method comprising:

providing a support member comprising an outer support surface, a male element, and a stem inside the male element;

providing a member comprising a first member made of electrically conductive material, wherein the first member comprises a first tubular sleeve extending along a longitudinal direction between a first top end and a first bottom end;

positioning the member on the support member;

applying a magnetic field on the member to deform at least a portion of the first tubular sleeve around the support member to form the closure member;

removing the stem from the male element; and after the stem has been removed from the male element, extracting the male element from the formed closure member;

wherein positioning the member on the support member comprises moving the support member relative to the member along the longitudinal direction until the support member contacts the first member, and wherein the formed closure member is configured to be applied on a neck of a container to be closed or on a closure body.

12. The method of claim 11, wherein a first annular gap is defined between the first tubular sleeve and the outer support surface, and wherein the at least the portion of the first tubular sleeve is deformed directly against the support member so that the deformed portion of the first tubular sleeve is shaped as the outer support surface of the support member.

13. The method of claim 11, wherein the first member is made of sheet material with thickness greater than or equal to 0.2 millimeters (mm) and less than or equal to 0.3 mm.

14. The method of claim 11, wherein the first member is made of sheet material with thickness greater than or equal to 0.21 millimeters (mm) and less than or equal to 0.25 mm.

15. The method of claim 11, wherein the first member is made of aluminum.

16. A method of forming a closure member, the method comprising:

providing a support member comprising an outer support surface, a male element, and a stem inside the male element;

providing a member comprising a first member made of electrically conductive material, wherein the first member comprises a first tubular sleeve extending along a longitudinal direction between a first top end and a first bottom end;

positioning the member on the support member;

applying a magnetic field on the member to deform at least a portion of the first tubular sleeve around the support member to form the closure member;

removing the stem from the male element; and after the stem has been removed from the male element, extracting the male element from the formed closure member;

wherein positioning the member on the support member comprises moving the support member relative to the member along the longitudinal direction until the stem of the support member contacts a first inner top surface of the first member, and wherein the formed closure member is configured to be applied on a neck of a container to be closed or on a closure body.

17. The method of claim 16, wherein a first annular gap is defined between the first tubular sleeve and the outer support surface, and wherein the at least the portion of the first tubular sleeve is deformed directly against the support member so that the deformed portion of the first tubular sleeve is shaped as the outer support surface of the support member.

18. The method of claim 16, wherein the first member is made of sheet material with thickness greater than or equal to 0.2 millimeters (mm) and less than or equal to 0.3 mm.

19. The method of claim 16, wherein the first member is made of sheet material with thickness greater than or equal to 0.21 millimeters (mm) and less than or equal to 0.25 mm.

20. The method of claim 16, wherein the first member is made of aluminum.

* * * * *